US006341583B1

(12) United States Patent
Ryu

(10) Patent No.: US 6,341,583 B1
(45) Date of Patent: Jan. 29, 2002

(54) TORQUE INCREASING OPPOSITE DIRECTION ENGINE

(76) Inventor: Kil Jung Ryu, 347 Kumkon-Dong, Puk-Ku, Kwangju-si (KR)

( * ) Notice: Subject to any disclaimer, the term of this patent is extended or adjusted under 35 U.S.C. 154(b) by 0 days.

(21) Appl. No.: 09/581,250

(22) PCT Filed: Dec. 28, 1998

(86) PCT No.: PCT/KR98/00474

§ 371 Date: Jun. 26, 2000

§ 102(e) Date: Jun. 26, 2000

(87) PCT Pub. No.: WO99/34101

PCT Pub. Date: Jul. 8, 1999

(30) Foreign Application Priority Data

Dec. 27, 1997 (KR) ..... 97-74848

(51) Int. Cl.[7] ..... F02B 75/28
(52) U.S. Cl. ..... 123/54.4
(58) Field of Search ..... 123/54.4, 78 C

(56) References Cited

U.S. PATENT DOCUMENTS 3,340,858 A * 9/1967 Gerin ..... 123/78 C
4,144,851 A * 3/1979 Prosen ..... 123/78 C
4,644,916 A 2/1987 Kitagawa
4,683,849 A 8/1987 Brown
5,228,416 A 7/1993 Puzio
5,934,228 A * 8/1999 Wheat ..... 123/78 C
6,058,901 A * 5/2000 Lee ..... 123/54.4
9,178,932 * 1/2001 Matsuda et al. ..... 123/54.4

* cited by examiner

*Primary Examiner*—Marguerite McMahon
*Assistant Examiner*—Jason Benton
(74) *Attorney, Agent, or Firm*—Jacobson Holman, PLLC

(57) ABSTRACT

A torque increasing opposite direction engine employs not a combustion pressure but a high pressure medium by using a differential shifting distance and velocity per angle and a differential equivalent distance of a crank radius depending on a crank angle to thereby have a common joining section of two pistons reciprocating each other in such a way that each upper dead point of two pistons presents in the upper dead point of any one piston in an opposite site to reduce a volume of the combustion chamber in burning. The inventive crank radius is same or different and a suction and an exhaust valves are positioned to a site away from an upper dead point of the piston located at the upper dead point in burning. When one piston is an upper dead point another piston is past the upper dead point. When the equivalent distance is large, a combustion pressure in a narrow space is increased by narrowing the distance between two pistons, thereby increasing a generated torque.

3 Claims, 12 Drawing Sheets

TORQUE INCREASING OPPOSITE DIRECTION ENGINE

TECHNICAL FIELD OF THE INVENTION

The present invention relates to a torque increasing opposite direction engine; and, more particular, to a torque increasing opposite direction engine capable of generating a torque in a site, where an equivalent distance(r sinθ) of a diameter of a crank proceeding a bottom dead point, when an exhausting pressure is maximum, is longer than that of a conventional crank by using an combustion chamber which is smaller than that of a conventional chamber, wherein one crank pin is in an angle of 0°, while another is in an angle of optional, and capable of increasing the torque in a machine by using a high pressure medium and no burning a fuel.

BACKGROUND ART

In a conventional opposite direction engines, two pistons having the same upper dead point are reciprocated as shown in FIG. 1A, wherein a crank pin is subjected to a phase difference and a piston reciprocating area is not partially held in common, a fuel injecting valve is mounded on an upper dead point of two pistons as shown in FIG. 1B, or a maximum compression is generated at an upper dead point by compressing two pistons likewise a general opposite direction engine using one piston. When two pistons have the same upper dead point, a suction and an exhaust valves are disposed to both sides of a cylinder at the upper dead point. In this case, two crank pins are different of a phase from the case as shown in FIG. 1C. As a result, when a piston positioned in a below of an upper dead point before a fuel is not burned, is proceed to the upper dead point, the fuel is injected and compressed to thereby reach to the upper dead point, thereby completing the burning of the fuel.

Since, however, the piston positioned in the below of the upper dead point before the fuel is not burned, is shifted toward a bottom dead point in the same distance, length between the two pistons in case of no partially holding in common the reciprocating area at the same condition is fifth larger than that in the contrary case. Further, since a fuel injecting valve body is disposed within the cylinder from the upper dead point of two pistons and an upper side of a piston shifting into the upper dead point in bring and meeting with the fuel injecting valve is not extended in order to allow the piston to strike to the fuel injecting valve such as an opposite piston, the distance between two pistons is added to the half of an outline of the fuel injecting valve. As a result, if the common joining area is present during two pistons is reciprocated and the diameter and the crank angle of each of the cranks is same to each other, an amount of the mixing gases mixed with a theory combustion rate of air and fuel is further requested or the fuel is further supplied than the fuel combustion rate in order to generate the same combustion pressure thereby increasing the fuel consumption. Further, the compression rate is same or decreased at the combustion chamber having a large volume so that it is impossible to generate a torque at a leak mixing rate. Although the compression rate is same, the transferring time of a frame is lengthened because the surface area of the combustion chamber is large, thereby deleting the frame, in turn, thereby expanding the frame in an incomplete combustion condition and thereby decreasing the combustion pressure. Furthermore, although the combustion of fuel is completed in a position, where the distance between two pistons is narrowest so as to obtain a complete combustion, the combustion pressure is high, while a rotation force is generated by a difference of an equivalent distance between the diameters of each of the pistons. Therefore, two crank pins give a difference of phase and the reciprocating pistons have not a common joining area so that the distance between two pistons or the volume of the combustion chamber may be small, thereby improving an output of engine. When the action as described above is not performed, the engine output is decreased and even though is increased, it is a shortcoming that the increased amount is not satisfied and the fuel consumption is increased. Accordingly, although the equivalence distance of the diameter of each of the cranks is lengthened by differentiating the angle of each of the cranks in order to improve the output of engine at the theory combustion rate, the volume of each of the combustion chambers and the compressive rate are differentiated to thereby allow the combustion pressure to reduce about ⅕ or over after the combustion is completed because the distance between two pistons are large when each of the combustion chambers formed on the surface thereof have a same volume.

On the other hand, in an opposite direction type engine, it is impossible for a forfeit valve to be used as commonly available valve. Therefore, a rotational valve is used, however, an inlet and an exhaust valves are mounted on an upper dead point of the rotational valve, thereby entailing a leakage of a high combustion pressure through a sliding surface of the valve. Further, when two crank angles are different to each other, the maximum compressive point in burning the fuel is past upper dead point of one piston and is before upper dead point of another piston such as a conventional type, thereby being minimum. Accordingly, until the rotational force of the piston positioned before upper dead point is generated past upper dead point, the rotational force is generated by a difference of the equivalent distance of each of the crank diameters. When the equivalent distance of the crank pin positioned to before upper dead point in burning is large, the combustion pressure is large to thereby push the piston to opposite direction against the rotating direction due to the difference of the equivalence distance, thereby not generating the engine start. Furthermore, when the engine is intended to allow two pistons to inject past upper dead point, the crank angle being a maximum pressure has a considerable different in such a way that a beat generated by the compressive pressure is cooled and the compressive rate is low, thereby being difficult to inject in easy. Further, the piston is moved to both direction regardless the volume of the combustion chamber so that a larger torque is not generated.

DISCLOSURE OF THE INVENTION

It is, therefore, a primary object of the present invention to provide an opposite direction engine capable of improving a heat efficiency by ending a stroke of a piston and rapidly dropping absolute temperature ($T \simeq PV$) and of increasing a torque by means of a higher combustion pressure when an equivalent distance of a diameter of each of two cranks is large.

In accordance with the present invention, there is provided A torque increasing opposite direction engine, the engine comprising:

a V-shaped cylinder block formed in a straight line or in parallel, wherein two center lines of the cylinder positioned to both sides of a crank shaft are in a straight line, the cylinder block including an exhaust valve formed in a position of the cylinder having a lower combustion pressure, an inlet and outlet valve formed in an opposition of the cylinder, a valve positioned to a position where an exhaust gas is further exhausted by two pistons or a piston and a cylinder liner tub in an exhaust operation or a cylinder liner positioned to a position where the cylinder block can be cooling by a cooling water or a heat radiating plate or not using, and an exhaust port penetrated toward upper dead point in case of using a higher pressure medium; and a crank shaft corresponding to a cylinder and two pistons capable of reciprocating a plurality of into three directions having a common joining areas, the plurality of crank pins having a diameter of 15 mm or over, respectively, a first crank pin disposed to a center, the remaining crank pins having a same diameter or a different diameter, wherein crank pin to the first cylinder being 0°, and another crank pin being 80° to 173°, while if two pistons have not common join areas, one crank pin being 0°, and another crank pin being 130° to 173°;

wherein the upper surface of two piston is substantially planar excepting a portion where a flow is generated, the cylinder liner tub is functioned as a valve in the cylinder, a cylinder liner and a piston, and further including a tensionnor capable of selectively using with a cylinder head having a directional valve, a cylinder liner and a S-shaped magnetic insulting conductor.

BRIEF DESCRIPTION OF THE DRAWINGS

The above and other objects and features of the present invention will become apparent from the following description of preferred embodiments given in conjunction with the accompanying drawings, in which.

MODES OF CARRYING OUT THE INVENTION

Figure 1A:
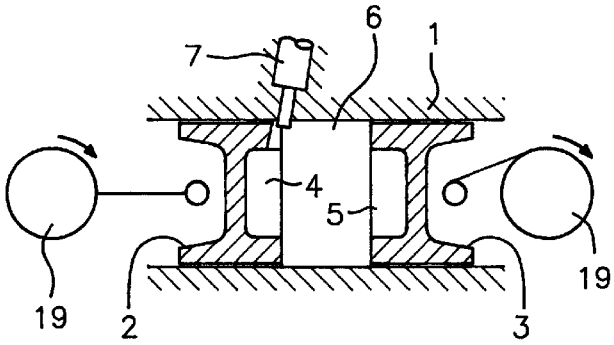
FIGS. 1A to 1C illustrate a schematic sectional view of a conventional opposite direction engine.
Figure 1B:
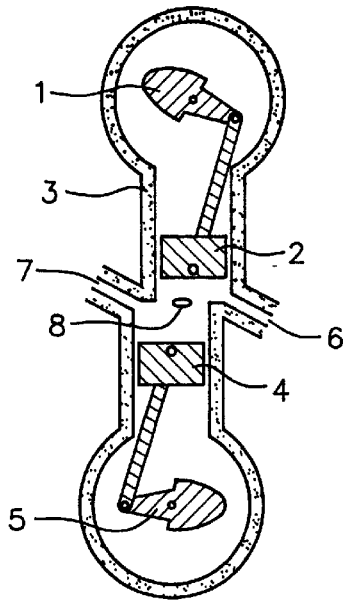
Figure 1C:
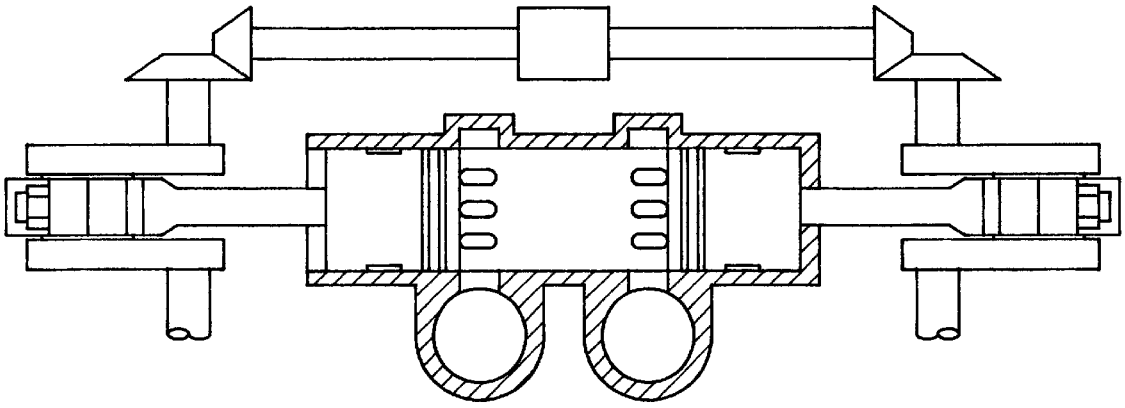
Figure 2:
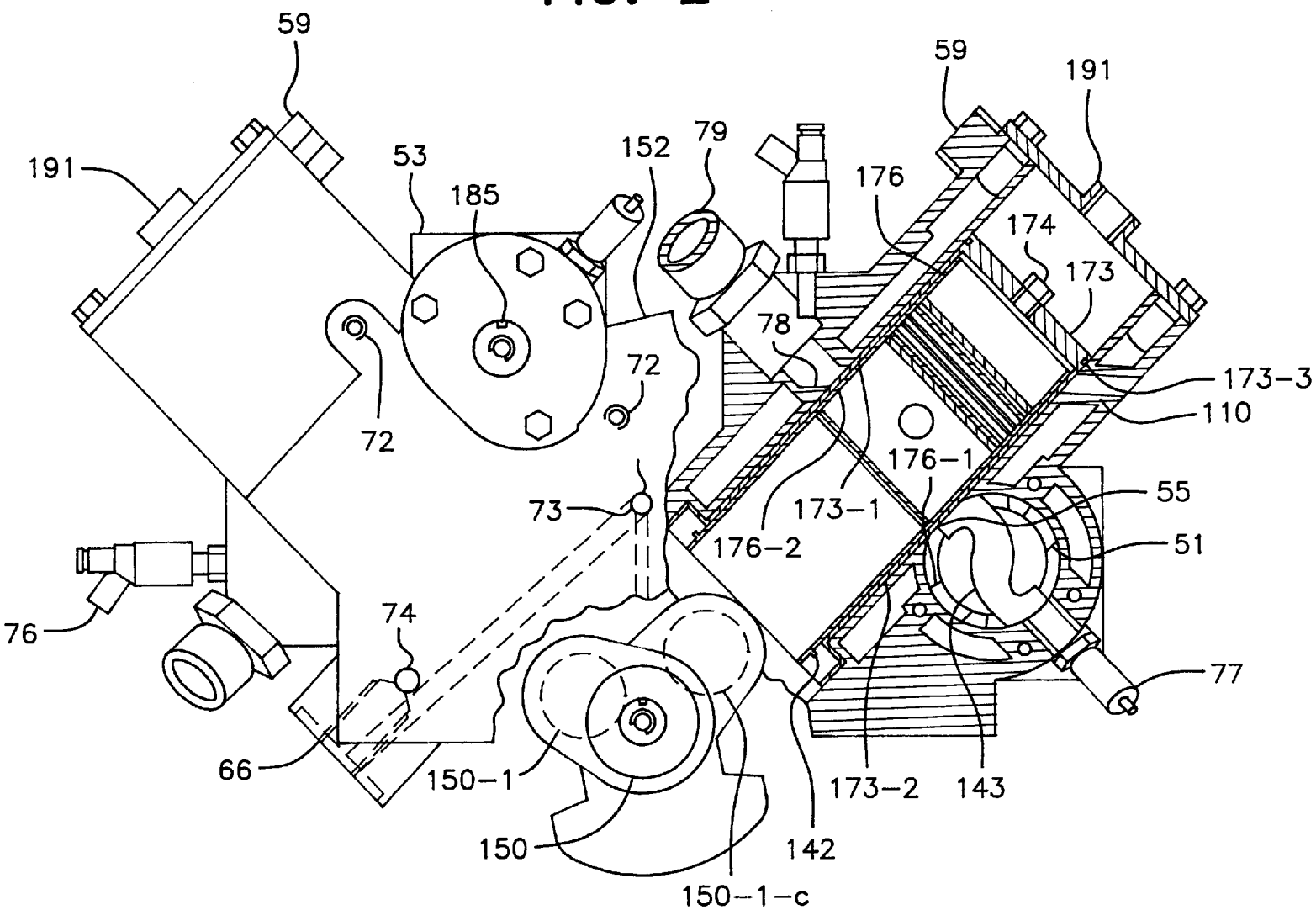
FIG. 2 shows a partially cut-out front view for showing an opposite direction engine in accordance with a first embodiment of the present invention.

The present invention employs that when a piston operates from an upper dead point to a bottom dead point and vice versa, a distance and a velocity per a crank angle are different to each other and that an equivalent distance of radius of each of cranks is different according to the crank angle. If the equivalent distance is large, a body of a fuel injecting valve is not inserted into a cylinder to thereby reduce a combustion chamber. Further, if two pistons have a common joining section during reciprocating, the surface area of the combustion chamber to the volume thereof is small in burning due to a velocity difference of two pistons. Accordingly, when the combustion chamber formed at a surface of the piston is same condition, the volume of the combustion chamber in accordance with the present invention becomes ⅕ and less than that of the prior art embodiment as described in FIG. 1 to thereby obtain 5 or more output. The present invention includes a first embodiment consisting of FIGS. 2 to 5 and a second embodiment consisting of FIGS. 6 to 8. According to the present invention, two pistons serve as a piston and a cylinder head and perform two strokes and four strokes of a suction, a compression, an explosion, and an exhaust. One crank pin adjacent to an upper dead point is pushed by a piston in an opposite direction to the rotating direction due to a combustion pressure or a compressive pressure in such a way that it is hard to be rotated by progressively increasing in size a force directing into a center of a shaft, whereas another crank pin rotates in easy relative to one crank pin and continuously rotates in the rotating direction by the difference of the equivalent distance of radius of each of the cranks to thereby reach to the upper dead point, hereinafter, rotates by the equivalent distance of radius of the respect cranks.

Table 1 presents values measured a distance between two pistons and expressed in terms of 10° from 60° of the upper dead point in advance to the upper dead point, wherein when θ1 is 0°, θ2 is θ as a perpendicular angle.

| | θB | | | | | | | CONNECTING | |
|---|---|---|---|---|---|---|---|---|---|
| θA | 0 | 10 | 20 | 30 | 40 | 50 | 60 | ROD | |
| 10 | 0.0 | 0.4 | 3.0 | 8.1 | 14.9 | 23.3 | 34.6 | 146 | 141 |
| 15 | 0.1 | 0.3 | 2.3 | 6.9 | 14.5 | 22.0 | 35.0 | " | " |
| 20 | 0.4 | 0.0 | 2.0 | 6.2 | 12.1 | 20.2 | 29.7 | " | " |
| 25 | 0.6 | 0.0 | 1.6 | 4.9 | 10.8 | 18.3 | 27.7 | 145 | " |
| 30 | 0.9 | 0.0 | 1.4 | 4.5 | 9.8 | 17.1 | 26.4 | " | " |
| 35 | 1.1 | 0.0 | 0.9 | 3.6 | 8.6 | 16.0 | 24.6 | 144 | " |
| 40 | 1.2 | 0.0 | 0.4 | 3.3 | 8.0 | 14.3 | 23.0 | " | " |
| 45 | 1.5 | 0.0 | 0.3 | 2.5 | 7.0 | 13.1 | 21.0 | 143 | " |
| 50 | 2.3 | 0.3 | 0.3 | 2.2 | 6.2 | 11.9 | 19.7 | 141 | " |
| 55 | 2.3 | 0.4 | 0.1 | 1.9 | 5.5 | 11.0 | 17.2 | 140 | " |
| 60 | 3.3 | 0.6 | 0.0 | 1.8 | 5.0 | 10.1 | 16.8 | 139 | " |
| 65 | 4.0 | 1.3 | 0.3 | 1.4 | 4.2 | 9.0 | 15.3 | 137 | " |
| 70 | 4.4 | 1.5 | 0.0 | 1.0 | 3.9 | 8.2 | 14.0 | 136 | " |
| 75 | 5.2 | 1.6 | 0.0 | 0.6 | 3.2 | 7.1 | 12.2 | 135 | " |
| 80 | 6.3 | 1.8 | 0.0 | 0.5 | 2.3 | 6.4 | 11.5 | 132 | " |
| 85 | 6.8 | 2.5 | 0.3 | 0.4 | 2.2 | 5.5 | 11.0 | 130 | " |
| 90 | 7.3 | 3.0 | 0.9 | 0.3 | 2.0 | 5.3 | 10.1 | 129 | " |
| 100 | 7.8 | 3.5 | 0.5 | 0.0 | 0.8 | 3.1 | 7.2 | " | " |
| 110 | 8.0 | 4.2 | 1.6 | 0.2 | 0.8 | 2.8 | 6.2 | " | " |
| 120 | 8.7 | 4.5 | 1.7 | 0.0 | 2.0 | 1.4 | 4.3 | " | " |
| 130 | 8.6 | 4.8 | 2.7 | 0.3 | 0.5 | 1.5 | 4.0 | " | " |

Figure 15:
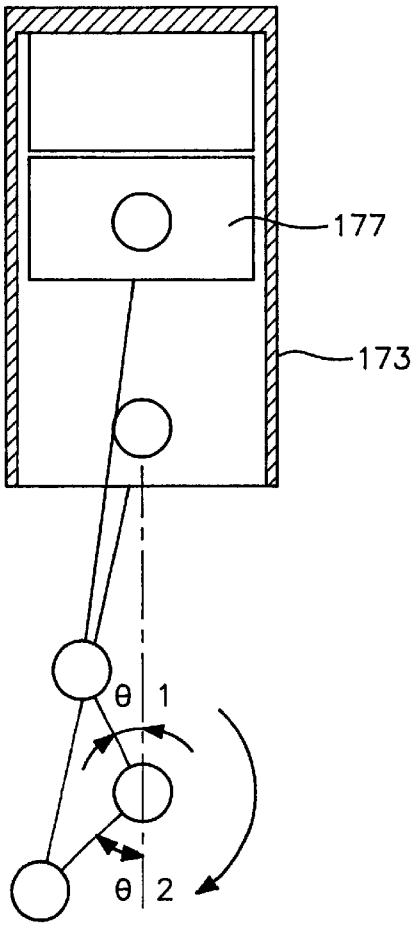
FIG. 15 is a diagram showing an angle relationship between two crank pins.

As best shown in table 1 obtained by FIG. 15, a compressive pressure due to the difference of the equivalent distance of radius of the respective cranks serves as a rotational force in part in 0 position of the table 1. In table, L1 and L2 mean legs of a connecting rod, which is corrected to a small radius crank and a large radius crank. For instant, as shown in FIG. 15, each radius of θ1 and θ2 cranks is 42 mm. When θ1 is 0°, θ2 showing an angle between two crank pins is θ as a perpendicular angle as shown in table 1. When θ1 is 0° to 60° as an angle from an upper dead point to the upper dead point in advance, the value measuring a distance between two crank pins is mm number in table 1. Further, when the difference between two crank pins is large, 0 point is shifted on the right side, whereas when the different therebetween is small, 0 point is shifted on the left side. Further, after completing the combustion, two pistons performs an exhaust action, wherein one piston not positioned to the upper dead point is down into a stroke section of another piston positioned thereto. However, a crank angle capable of using a combustion pressure is small to thereby deteriorate a heat efficiency, thereby being unfavorable to perform the compression and to allow a knocking to generate. On the contrary, when the different between two crank pins is small, a combustion pressure just after a combustion cannot use in optimum. The absolute temperature is not rapidly reduced, but it is favorable to perform the compression and the crank angle using the combustion pressure becomes a large.

Since the absolute temperature is rapidly reduced, the outer walls of the cylinder valve is cooled by a radiant heating plate without having a cooling water. Thus, a lidena 56 shielding and sealing a valve shaft is disposed at one side thereof, whereas a stopper fuels up at another side thereof or a pressure air get into the inner portion of the shaft through the stopper. Further, in die casting, a cylinder block is prepared by forming a core as a cylinder liner made of a premachined cast iron in order to work in easy or if the cylinder liner is made of aluminum alloy, the cylinder block is coated by a resistant wear materials.

In case of an indirect injection, one embodiment for supplying a voltage into a surface of a piston uses that a velocity is slow at a nearby upper dead point. When the voltage generated by a distanceharge is supplied into a side electrode of the piston at a side of the cylinder in such a way that one to three electrodes which are embedded or disposed to one piston of a combustion chamber formed on the surfaces of two pistons spark. Further, in accordance with the another embodiment of the present invention using an injection plug, another piston can earth into the plug in injection time by a sliding spring grounded to the cylinder block. In case of a direct injection, a portion or two portions of the upper end of two pistons get partially dug to thereby secure an injected fuel passage and a shape of the combustion chamber formed on the surface of two pistons is different or same, but cross each other, or the center point of the shape is eccentric in such a way that before and beyond an ignition a turbulence flow of the combustion chamber becomes a large within a permitted limit of surface area to the volume of combustion chamber.

Hereinafter, as shown in FIG. 15, when θ1 is 0°, a first piston, a first upper dead point, and a first crank pin are placed to a lower portion of FIG. 15, whereas when θ2 is 0°, a second piston, a second upper dead point, and a second crank pin are placed to an upper portion thereof. A crank angle during a stroke of a piston is θ1. If need, an exhaust valve and a hole for use in a valve disposed to a shaft of a valve can replace with a exhausting shaft and a valve, respectively, according to user selection. Further, In a first and a second embodiments, a tub having a suction and scavenging hole at a side and an exhausting hole at other side for functioning as a cylinder liner and a piston can replace with a liner tub (a second piston). It is normal that a connecting rod is to allow a middle portion thereof to be eccentric from a center line of a widthwise of a larger end thereof. A stopper which is connecting with a directional valve covering an upper end of a cylinder can replace with a cylinder head. Furthermore, it is fed that a stationary member is fastened by a bolt and a nut, and a bolt and a tap site, whereas it is rotated that a moving member is fastened thereby. The inventive engine includes a radiant heat plate, an oil pump, a compressive air storage tank, a generating means of the compressive air and so forth.

Figure 3:
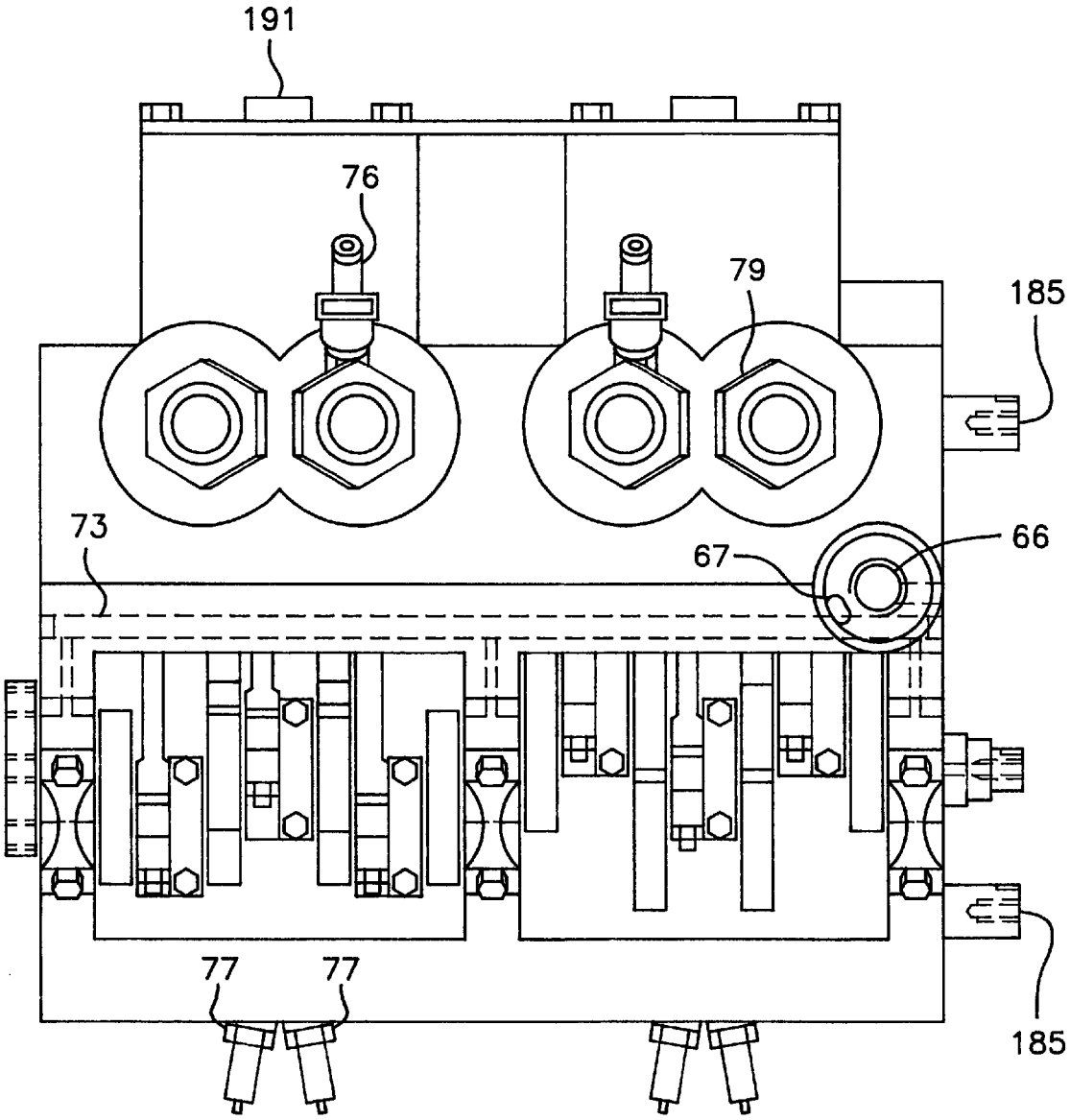
FIG. 3 represents a left elevation view of FIG. 2.
Figure 5:
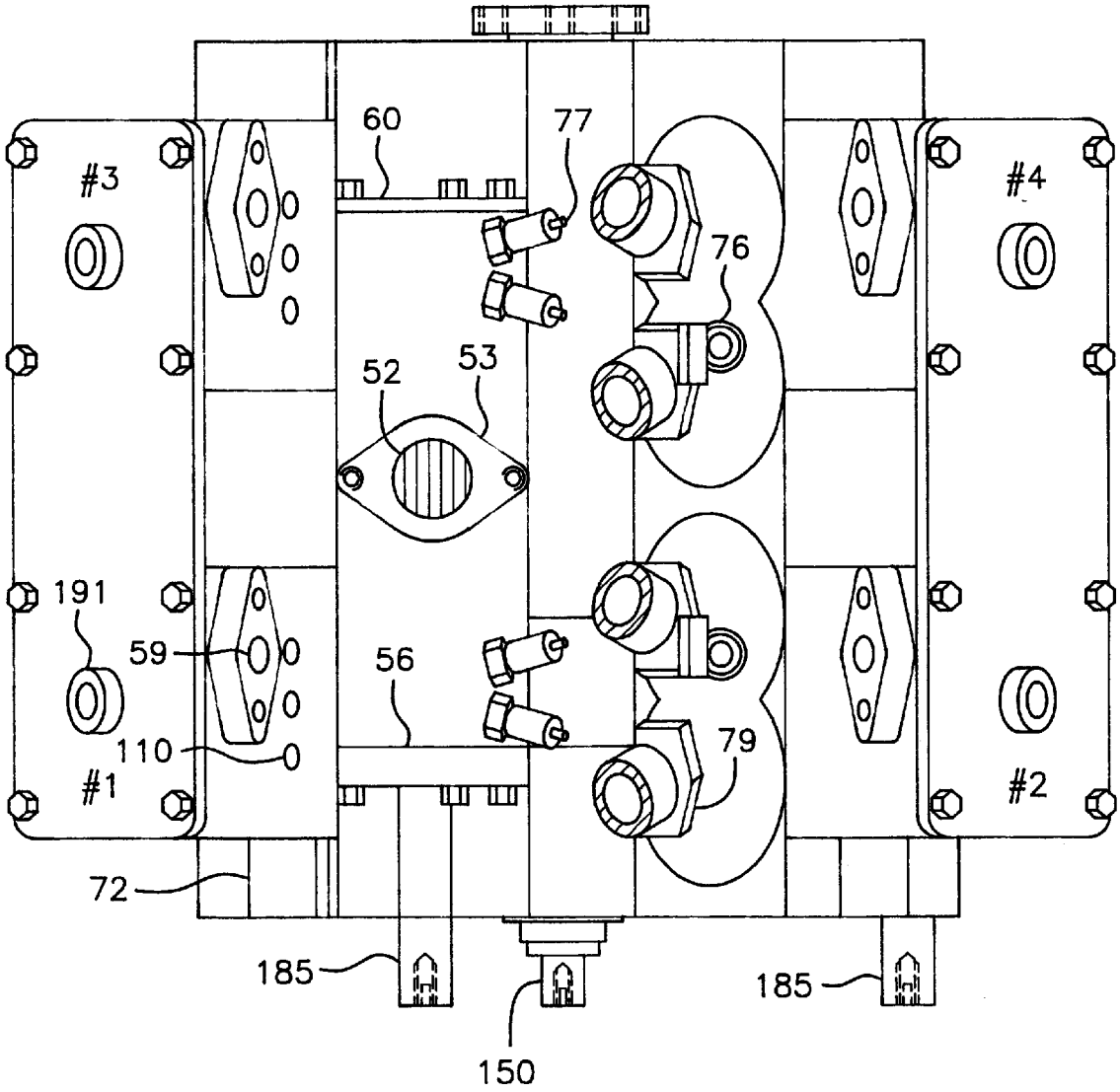
FIG. 5 set forth a plan view of FIG. 2.
Figure 9A:
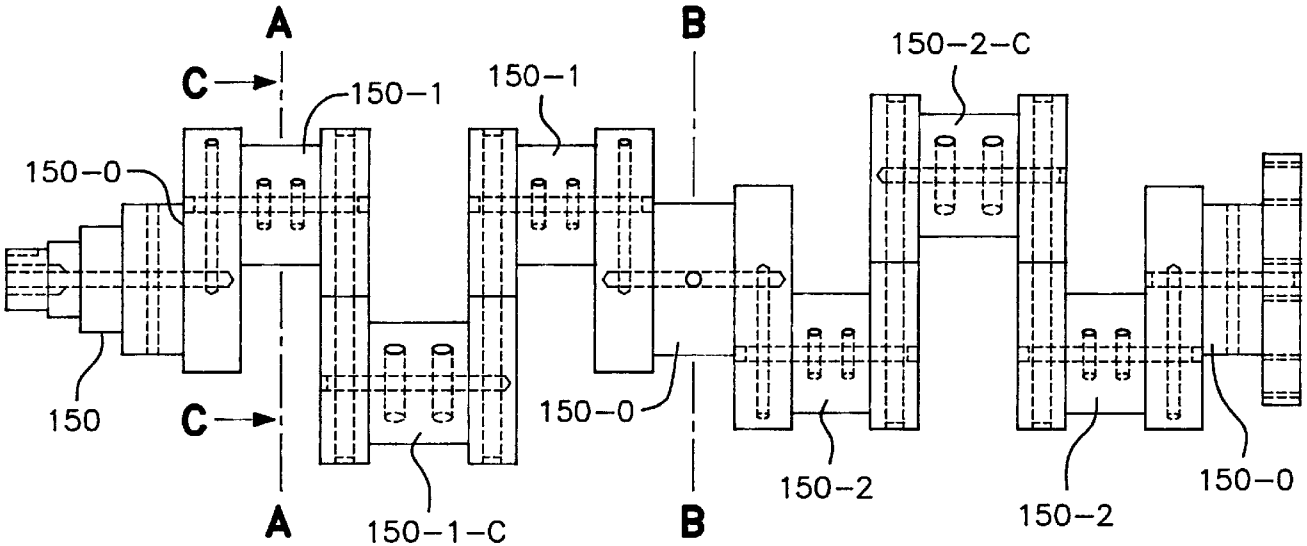
FIGS. 9A and 9B are a front and a plan views of a crank shaft of FIG. 2, respectively.
Figure 9B:
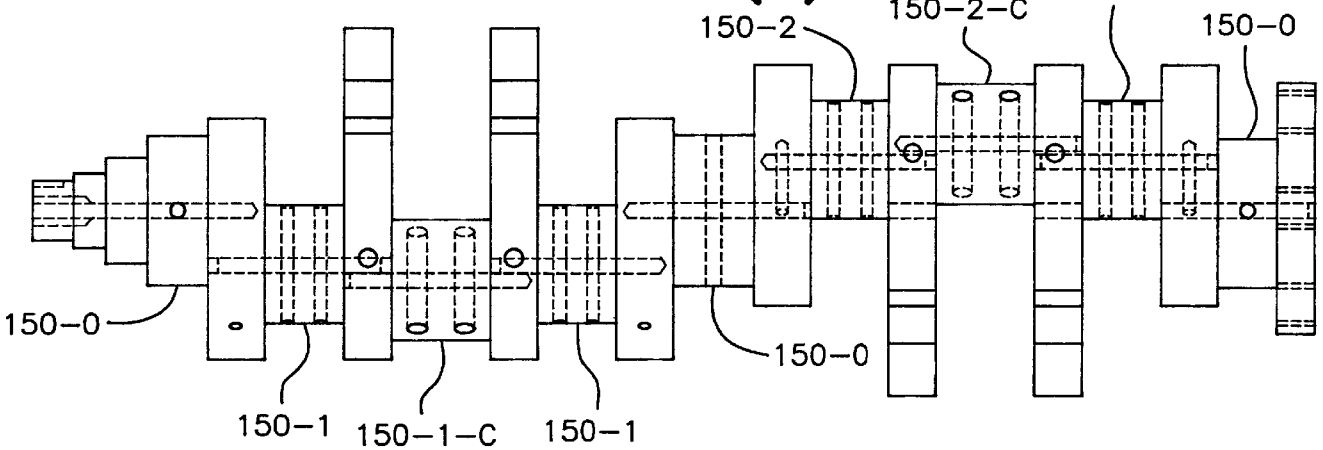
Figure 10:
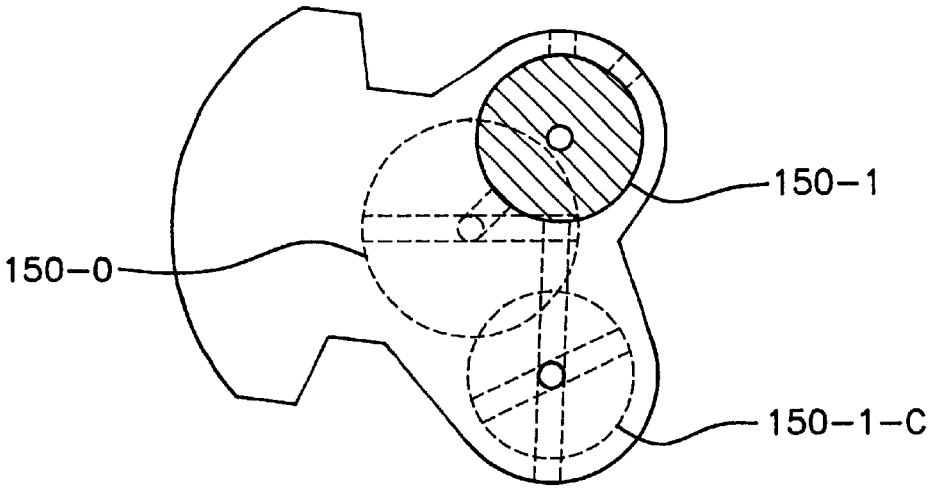
FIG. 10 is a sectional view taken along C—C line in an area of A—A and B—B lines of FIG. 9.

In accordance with a first and a second embodiments of the present invention, it is preferred that a crank shaft is used. Accordingly, the present invention makes a small time and cost of processing, weight, etc rather than uses two crank shafts while generating an compressive air required into each of the cylinders no helping outside aid and making a small. Since a torque angle is generated at intervals of 90° and a crank shaft is rotated once, a balanced torque than an angular velocity is generate. The present invention includes a V-shaped cylinder block as shown in FIGS. 3 and 5, a crank shaft as shown in FIGS. 9 and 10, a crank shaft cylinder liner tub 173 having a radius which is replaeed with each other or same, a first piston with an embedded electrode, a second piston without having an electrode, a cylinder head 191, a S-shaped magnetic insulating conductor 143 for transferring a voltage into an electrode 175 placed to a side of the first piston and inserted into an exhaust valve, a cylinder liner 176, a member for gripping the cylinder liner 176, a bolt 172 and a pin 173-5 for fixing the second piston. One crank pin is provided with two connecting rods having a same length, respectively, for reciprocating the first piston and the cylinder liner tub 173.

Referring to sections of the crank angle, the sections comprises a combustion pressure serving as a rotating force operating section of 0° to 90°, an exhaust gas exhausting section by two pistons of 90 ° to 200°, a scavenging section of 200° to 240°, a suction section of 240° to 280°, a compressive section compressed by a low compressive rate of 280° to 335°, a combustion section increasing a pressure in a combustion chamber by a high compressive of 335° to 355°, and a section for partially applying a contrary force to a rotating direction by a combustion pressure of 355° to 360°. However, an opening time and an ignition tie of a pressure valve and the sections are changed depend on the rotation number and the scavenging operation is performed simultaneously with an opening of an exhaust valve.

FIG. 3 is a front view of the first embodiment of the present invention. As shown, a crank angle is 0° to the second cylinder and a first piston is placed to an first upper dead point under a connecting rod is removed. Further, valves 176-2 and 173-1 is placed in such a way that the first piston is passed an upper portion of a suction hole 78 at 76° of the first upper dead point in advance, thereby completing a suction operation simultaneously with a valve is closed. An exhaust gas generated in each of the cylinders enters a hole 51 penetrated in an inner portion of a shaft through a hole 55 penetrated inward the cylinder and then is exhausted to an exhaust manifold 53 through a hole 52 penetrated toward an outside of the shaft. The exhaust valve is closed just before the suction.

The cylinder liner tub 173 performs a rectillineal sliding movement between an inside of the cylinder and an outside of the cylinder liner 176, thereby performs a valuing operation between the suction and the scavenging holes 78 and

78-1 and the exhaust hole 55 positioned to the side of the cylinder. The suction hole 78 is connected to a compressive air storage tank and a connecting pipe 79. The side of the cylinder is penetrated in angular through the suction hole 78 of a first and a third cylinders, while the other side thereof is penetrated through that of a second and a firth cylinders. The second piston in an inside of the cylinder liner tab 173 is fixed by the bolt 174 and the pin 173-5 positioned at top thereof to thereby compress from a space of a bolt head 174. The bolt head 174 is smaller hand a hole of a connecting tap 191 formed on the cylinder head on which a directional valve is mounted. When the compressive is completed, the bolt head is inserted into the hole to thereby minimize between the cylinder liner 173 and the cylinder head 191, thereby obtaining a maximum compression. The compressed air is supplied through the directional valve into the storage tank, but it is preferred to use a plurality of piston rings with regard to a leakage amount in the course of compressing due to one piston ring. Further, when a pressure of the storage tank is insufficient, an air is sucked from outside to the tank with a pressure which is higher than atmospheric pressure and secondarily compressed, thereby making a high a pressure of the tank.

Figure 11A:
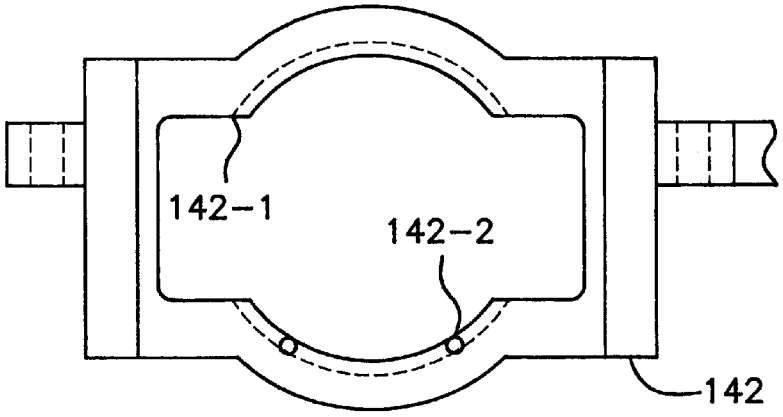
FIGS. 11A and 11B are a front and a plan views for illustrating a member for gripping a cylinder liner in the embodiments of the present invention, respectively.
Figure 11B:
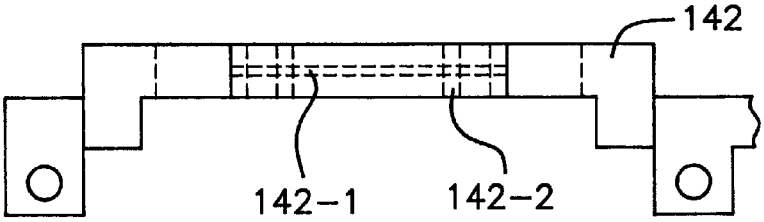
Figure 12A:
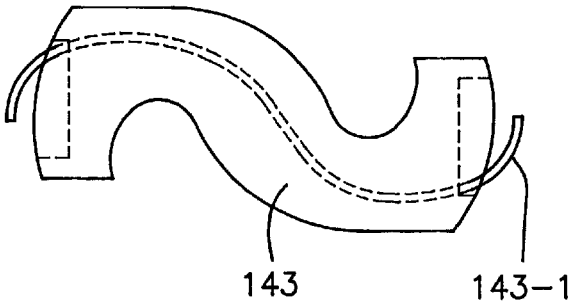
FIGS. 12A and 12B are a front and a right sectional views of S-shaped magnetic insulating conductor inserted into a shaft of an exhaust valve in the embodiments of the present invention, respectively.
Figure 12B:
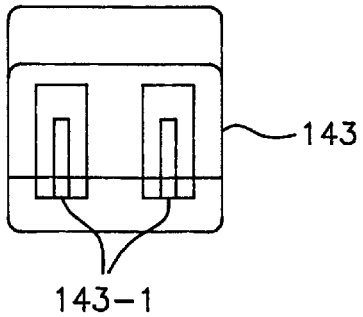
Figure 13A:
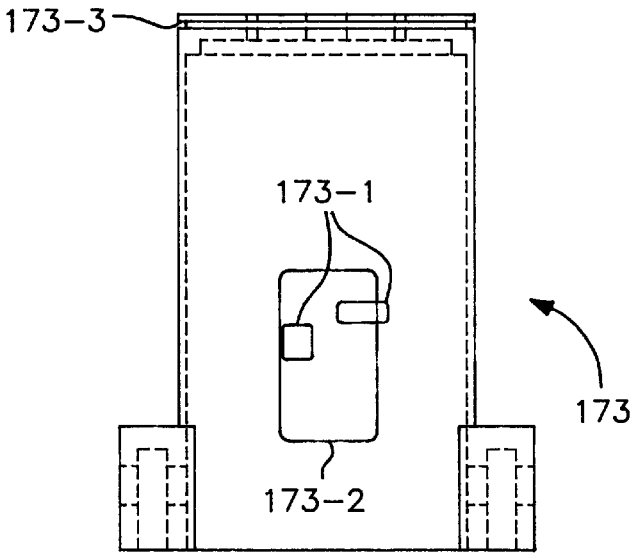
FIGS. 13A and 13B are a front and a bottom views of a cylinder liner tub functioning as a piston and a cylinder liner and a valve in the cylinder in accordance with the embodiments of the present invention, respectively.
Figure 13B:
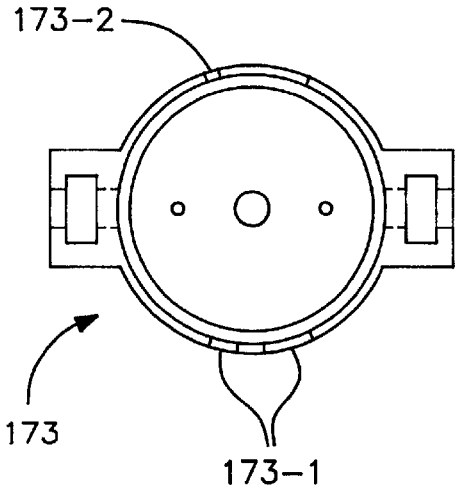
Figure 14A:
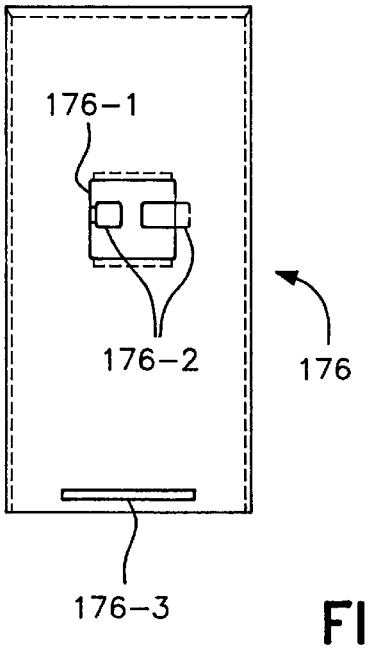
FIGS. 14A and 14B are a front and a bottom views of the cylinder liner between an inner side and the piston of FIG. 13.
Figure 14B:
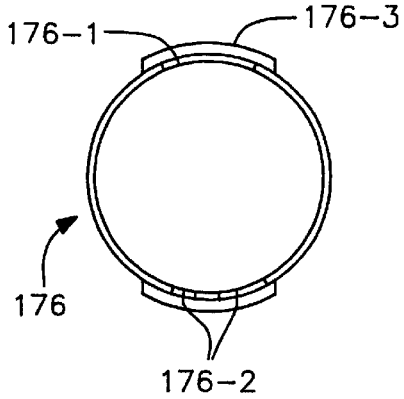

An upper end of the cylinder liner 176 is inclined to about 23° from outside to inside to thereby reduce a sliding resistance during a ring positioned to the second piston moves down to the first upper dead point. At this time, a thick of the cylinder liner 176 is thin about 1.5 mm or less as possible, because the combustion gas enters between the ring of the second piston and the inside of the cylinder liner tub 173 during the ring moves up to the second bottom dead point. A jaw 173-3 of a lower portion of the cylinder liner 176 fixes the cylinder liner by rotating the jaw to a center of a member (FIG. 11) for gripping the cylinder liner and screwing the member into a tap portion of a crank chamber with a bolt in order to be not rotated by two pins 142-2 positioned to both sides of a dot line 142-1.

The bird ring of a lower portion of the first piston is positioned to a site lower than the position, where suction and scavenging hole 176-2 and the exhaust hole 176-1 is positioned to a side of cylinder liner 176, thereby preventing the sucked mixing gas or the exhaust gas from entering into the crank chamber. Further, a S-shaped voltage transmitter 143 is rotatably inserted into a shaft of the exhaust valve for transmitting a voltage into an electrode 175 under the side of the first piston. The outer portion of the transmitter is made of magnetic insulator, while the inner potion thereof is provided with a conductor 143-1 for transferring a voltage and a material capable of preventing a magnetic field from breaking due to the difference of a heat expansion between the conductor and the magnetic field is covered around the conductor. It is preferable that the conductor 143-1 has a elastic to thereby restore an elasticity larger than a thickness adding a thickness of the cylinder liner tub 173 and that of the cylinder liner 176 so as to have a sufficient contact between the electrode of the first piston and that of the ignition plug 77. In the ignition time, the proceeding direction of the first piston is similar to the rotating direction of the valve 85 to thereby allow the contacting time of two electrodes to be lengthened. A tab 72 for fixing a beating housing so as to grip a shaft is disposed to a side of a block.

A cooling water mounting section 70 is disposed to a side of a second cylinder (not shown), though which a cooling water is supplied through a cooling passage 152 into an outer wall of a first and a third cylinders in left. Each of the cylinders is provided with a cooling drain port 59, which makes higher in order to smoothly circulate the cooling water. An oil supplied into of a crank shaft is pumped by only one oil pump through an oil filter mounting tab 66, a drain port 74 of a pump, an inlet port of the filter 67 and an oil passage.

Figure 4:
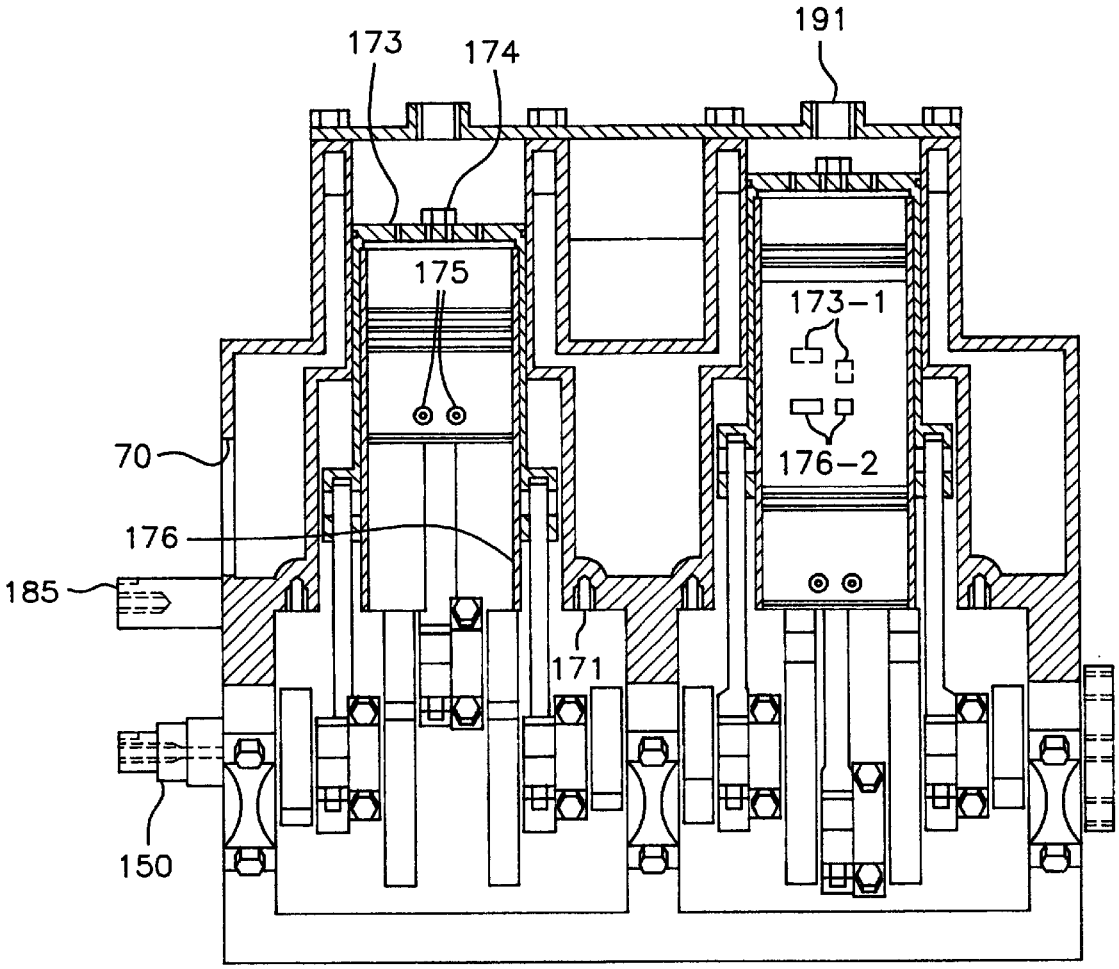
FIG. 4 depicts a detailed exploded view of a cylinder block of FIG. 2.

FIG. 4 shows a partially cut-out right elevation and sectional view making a front view of the first embodiment of the present invention make upright in right. As shown, the present invention includes an ignition electrode 175 formed on the first piston, a scavenging and suction hole 176-2 formed on the firth cylinder liner 176, and a scavenging and suction hole 173-1 formed in the cylinder liner tub 173 as shown in a dot line.

FIG. 5 shows a front view of the first embodiment of the present invention indicating an ignition order of each of the cylinders with #. As shown, the present invention includes an exhaust port of an exhaust valve mounted through a hole of an exhaust manifold 53 and a plug for sealing a shaft at both ends thereof and a connecting rod having a small distance in order to obtain two strokes by way of a direct injection means. In accordance with the direct injection method, a fuel injecting valve is mounthed on a nearby upper dead point positioned at top of the exhaust valve shaft and need not an igniting machine and a suction valve in such a way that a combustion air is sucked through a hole in scavenging by way of a scavenging valve and the scavenging operation is completed by the exhaust valve. On the contrary, in accordance with an indirect injection method, a connection rod has a lengthened distance, a cylinder liner 176 and a member (FIG. 11) for gripping the cylinder liner does not use by using each of the points away from the crank shaft, and the cylinder liner tub 173 is not provided with a second piston therein. In this embodiment, when the direct injection is performed without having an ignition machine, a fuel injection valve 76 is disposed to a portion or two portions to about 2 to 5 mm from an exhaust valve 185 toward a crank shaft 150 to a first upper dead point of a first piston. In case of the indirect injection, a voltage transmitter and an electrode can be disposed to an inner and outer sides of an upper end of the cylinder liner tub without having a S-shaped magnetic insulating conductor. At this time, the rotational valve can be removed. Further, this embodiment uses that an ECU decides an ignition time depending on a rotating number of an engine and a sprocket mounted on a crank shaft is disposed to a center of the engine. Two tensioners interconnected to each other are controlled by way of a tension control method, but the tension is not changed. As a result, when the tension become a strong in the same direction with the rotating direction of a valve, the rotation of the valve makes go ahead so much an amount in proportional thereto, while when the tension become a strong in an opposite direction therewith, the rotation thereof is behind in so much an amount thereof. A rotating angle of the tensioner for controlling the opening and closing time of the valve and the ignition time thereof is controlled by a hydraulic piston.

In the first and the second embodiments, an air can be sucked through two directional valves into a cylinder head 191 and compressed without having a suction port 110 in a side of a cylinder.

Furthermore, the engine of the present invention can be operated by not a combustion pressure but a high pressure medium which has not an compressing process to thereby not consume a part of the rotating force by disposing a valve in adjacent to a position which become a minimum distance between two pistons, in generating a power by pushing two pistons.

Figure 6:
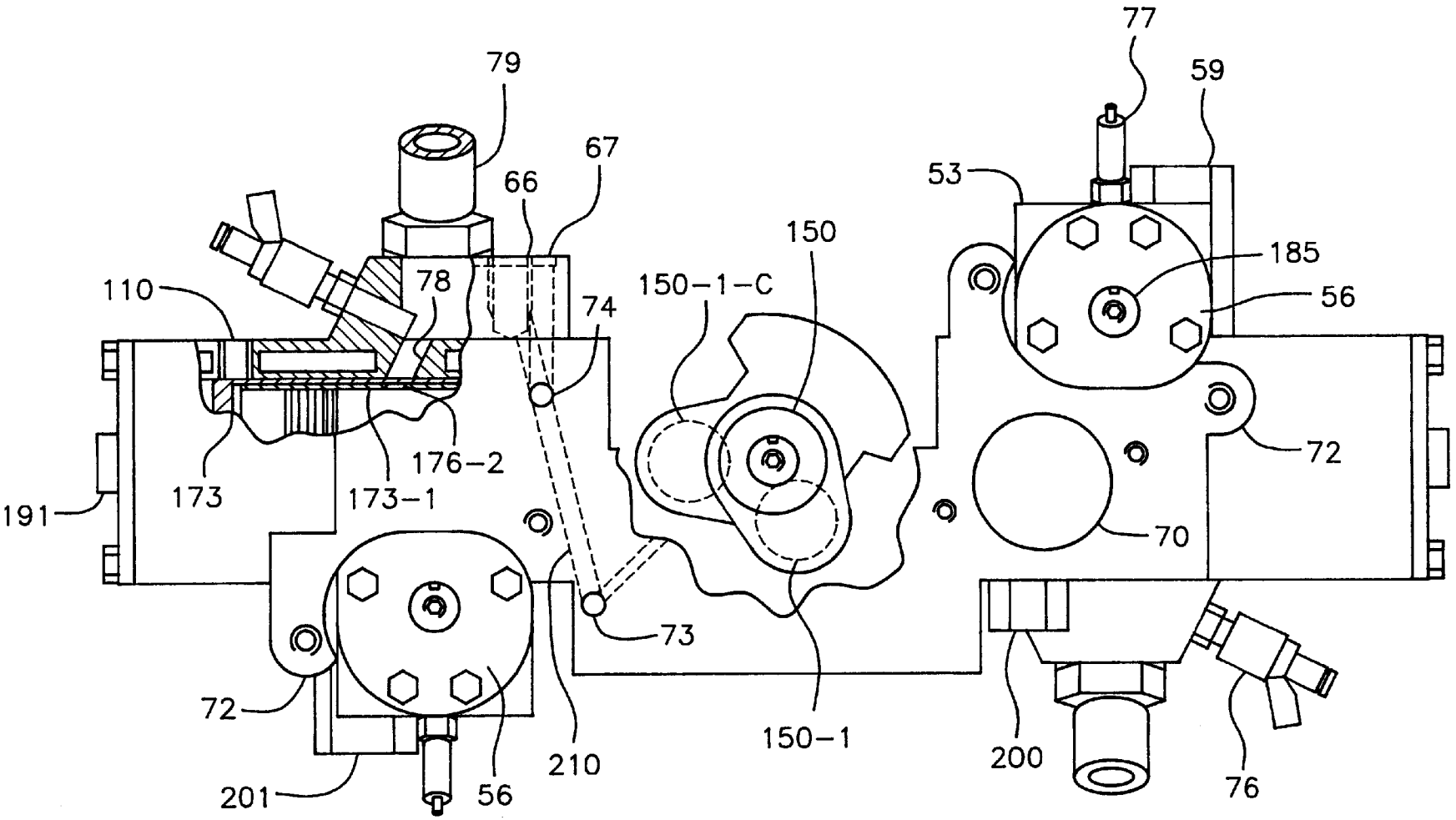
FIG. 6 is a partially cut-out front view for showing a cylinder block in accordance with a second embodiment of the present invention.
Figure 7:
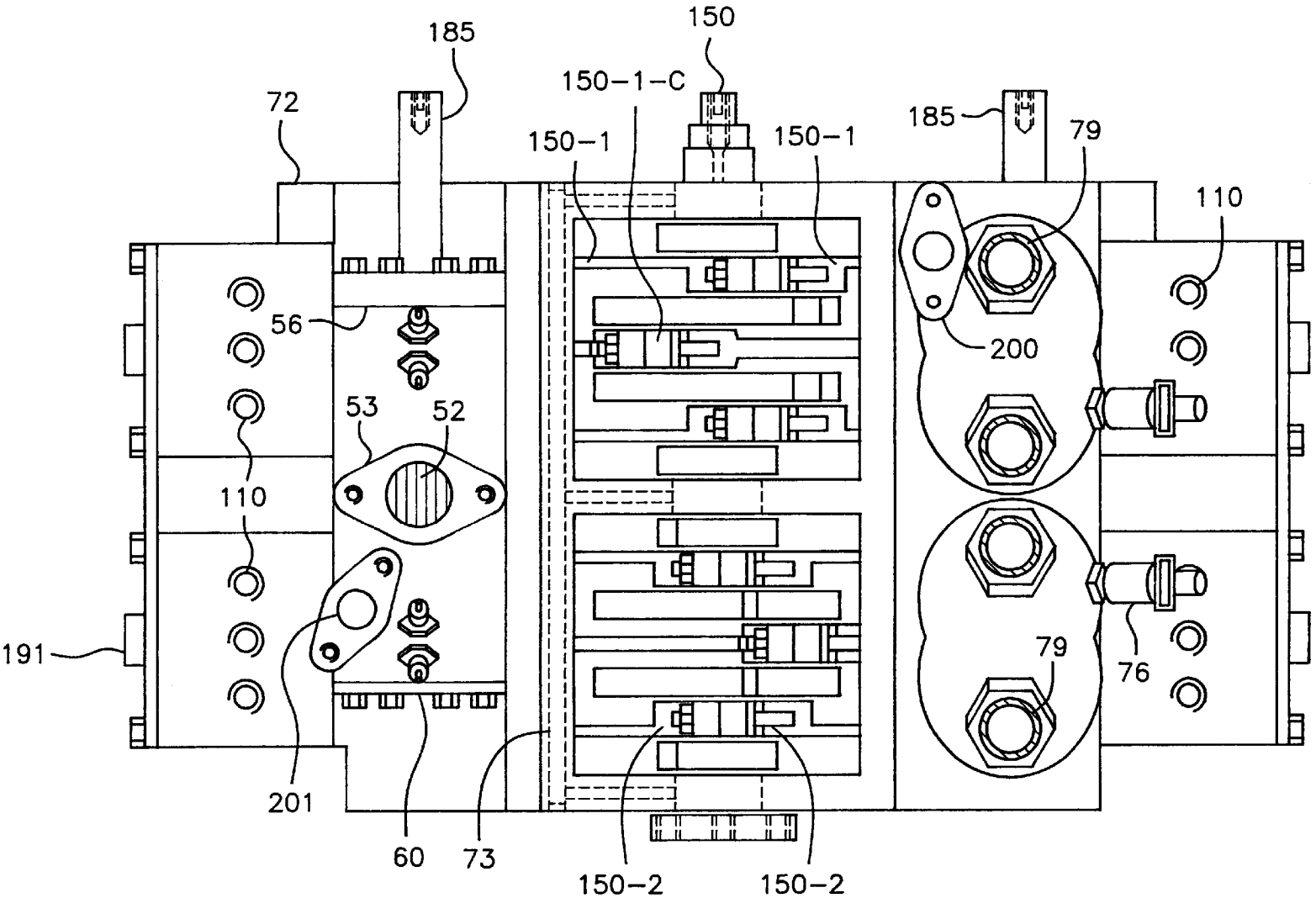
FIG. 7 is a left elevation view of FIG. 6.

In accordance with the second embodiment of the present invention employing an indirect injection method, one crank shaft and a equivalent cylinder block performs four strokes, thereby improving a heat efficiency relative to two strokes. Such an embodiment includes an equivalent cylinder block as shown in FIGS. 6 and 7, a crank shaft having an oil hole penetrated at center of width of a narrow crank pin as shown in FIG. 9, a bolt hole of a member (FIG. 11) for gripping a cylinder liner, but twisting so much that of 90°, and a connecting rod connected to a portion of a crank pin and a middle portion connected to an outside of a bearing by a pin. The remaining is similar to that as described the above first embodiment. In order to realize four strokes, one cylinder is provided with an exhaust axis 185 and a suction and scavenging shaft 183 with a suction hole and a scavenging holes 147-1 and 147, the length of two shafts having a little small. Referring to sections of the crank angle from a suction operation to an exhaust operation, the sections comprises a section for operating a combustion pressure in a rotating direction of 0° to 125°, an exhaust gas exhausting section by two pistons of 125° to 240°, a scavengn section of 240° to 280°, a section for closing a scavenging and a suction and an exhaust valves of 280° to 444°, a suction section of 444° to 582°, a compressive and combustion section of 582° to 715°, and a rotating section by a difference of an equivalent distance between radius of two cranks of 715° to 720°. However, each of the sections can be changed and the combustion section can be changed depending on the routing number of the ignition time, thereby performing four strokes by the indirect injection method FIG. 6 shows a front view of the second embodiment of the present invention. This second embodiment is similar to that of the first embodiment as described above, thereby performing four strokes by the indirect injection method. Accordingly, the detailed description thereof is omitted for convenience's sake.

FIG. 7 shows a left elevation view of the second embodiment of the present invention. As shown, a cooling water pumped at a cooling water pump mounting portion 70 positioned to a side of a second cylinder flows along an outer wall of the second cylinder. A lower portion of the second cylinder is provided with a cooling exit 200 which can supply the cooling water into an outer wall of the first and the firth cylinder in an opposite site. A pipe is connected to an entrance 201 which is positioned under of the firth cylinder in an opposite site of the exit and at outside of a cylinder block of an exhaust valve shaft 185 to thereby supply the cooling water into an outer wall of the cylinder in an opposite site. Therefore, the cooling water warming along the outer wall is drained into a drain port 59 positioned at top of the first cylinder and a drain port 59 positioned at top of the third cylinder and the exhaust valve shaft 185.

Figure 8:
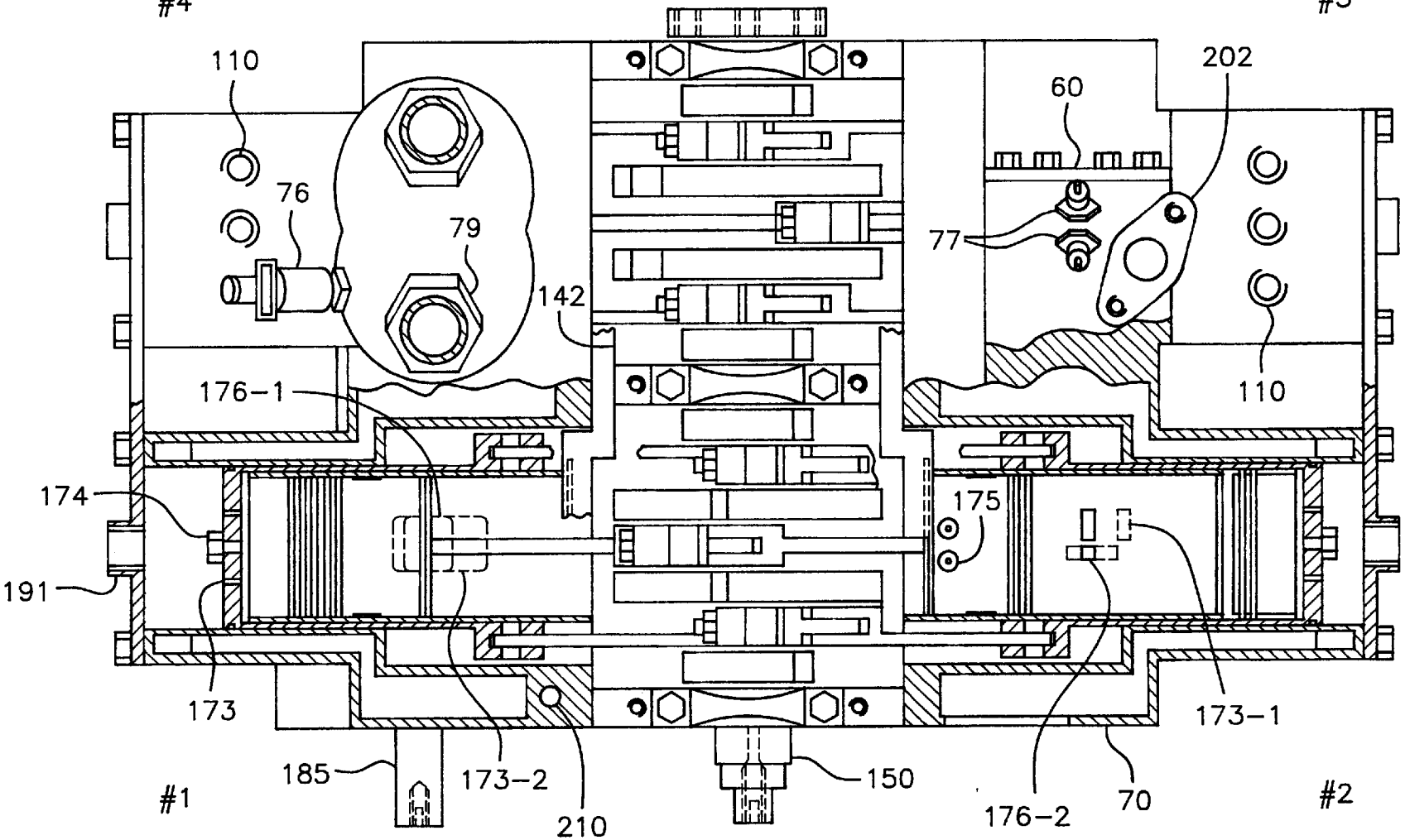
FIG. 8 is a partially cut-out right elevation view of FIG. 7.

FIG. 8 shows a right elevation view of the second embodiment of the preset invention, wherein an ignition order is indicated with # and a first and a second cylinders is cut-out.

The second embodiment is similar to the first embodiment except that two V-shaped cylinder blocks are employed. A center lined of at cylinder is not in straight but in parallel. When a rotational valve is employed, a hole of a valve is used to two strokes, allowing one equivalent cylinder block to simultaneously generate a torque at the first and the third cylinders and the second and the firth cylinders.

Increasing a crank pin within a limit permitting a twisting vibration of a crank shaft, a six-cylinder or a eight-cylinder can be prepared. Without a common joining section of two pistons, a remaining site of a surface of two pistons is substantially plane except for a turbulent flow generating site to thereby reduce a volume of a combustion chamber.

As described above, in the conventional engine, when a same or less load as a combustion pressure is applied to an output side thereof at some past an upper dead point, the combustion pressure serves as a small torque and a larger force toward a center of a crank shaft and a high temperature and a high pressure is changed into a low pressure during heat is radiated into a surface area of a combustion chamber, thereby stopping the engine. However, the present invention can reduce a combustion pressure or allow the pressure to be not radiated to the center of the shaft and generate a larger torque because the pressure is high due to a larger equivalent distance of the crank radius. Further, after completing the combustion, since the piston is rapidly expanded, the absolute temperature is rapidly drop down to thereby not increase hydrocarbon and generate a small amount of nitrogen oxide under a condition no employing an exhaust gas recirculating method and be shifted by two pistons a lot of distances at the same time under high temperature condition, in turn, since the heat absorbing time against a surface of a space formed in expansion becomes a small, having a advantage of using a heat or a pressure. A metal vibrating sound is generated from each part of the engine due to a compact wave generated in burning to thereby cause a noise. However, the inventive engine is the same as the velocity of the compact wave and the angular velocity of the crank shaft when a crank shaft is 0°, thereby partially absorbing the compact wave by a facing piston and reducing the noise. Further, the conventional engine should delay a combustion time or cannot use a high pressure shaft in order to restrict the production of nitrogen oxide, while there is no necessity for delaying in accordance with the inventive engine. Further, the inventive engine can perform a combustion by using a high pressure shaft having a mixing rate lower than the theory combustion rate. Although the rotating number of the inventive engine is increased, it is difficult to get scorched and sticks to a bearing of a crank shaft. If same displacement the inventive engine is a small engine, but an output of a large engine is achieved by increasing a torque, thereby reducing an atmosphere pollution. Further, a rotational valve using a cam shaft and a spring is employed to thereby easily open and close in comparison to the forfeit valve, and since a heat of high temperature in the engine is rapidly dropped down by two pistons in cooling the engine, a heat load of a cooling pump, a radiator or a radiant heating plate is reduced by a lengthened warning up time of a cooling water or the radiant heating plate. The volume of the combustion chamber and the distance between two pistons is small under a larger equivalent distance condition (⅕ or less), thereby improving the output and having a small surface area against the volume of the combustion chamber at the time of combustion and a simple s structure.

While the present invention has been described with respect to certain preferred embodiments only, other modifications and variations may be made without departing from the spirit and scope of the present invention as set forth in the following claims.

What is claimed is:

1. A torque increasing opposite direction engine, the engine comprising:

a V-shaped cylinder block formed in a straight line or in parallel, wherein two center lines of the cylinder positioned at both sides of a crank shaft are in a straight line, the cylinder block including an exhaust valve formed in a position of the cylinder having a lower combustion pressure, an inlet and outlet valve formed in an opposition of the cylinder, a valve positioned where an exhaust gas is further exhausted by two pistons or a piston and a cylinder liner tub in an exhaust operation or a cylinder liner positioned where the cylinder block is to be cooled by cooling water, and an exhaust port penetrated toward upper dead point in case of using a higher pressure medium; and a crank shaft corresponding to a cylinder and two pistons for reciprocating a plurality of crank pins into three directions having common joining areas, the plurality of crank pins each having a diameter of 15 mm or over, a first crank pin disposed to a center, the remaining crank pins having a same diameter or a different diameter, wherein one crank pin to the first cylinder being 0° and another crank pin being 80° to 173°, while if two pistons have no common joining areas, one crank pin being 0° and another crank pin being 130° to 173°;

wherein the upper surface of two pistons is substantially planar except a portion where a flow is generated and the cylinder liner tub is functioned as a valve in the cylinder, a cylinder liner and a piston; and wherein the engine further includes a tensioner capable of selectively using with a cylinder head having a directional valve, a cylinder liner and a S-shaped magnetic insulating conductor.

2. The engine according to claim 1, wherein said V-shaped cylinder block is formed in parallel, the crank pin having only one formed oil holed.

3. The engine according to claim 1, wherein a combustion pressure of a gasoline engine is generated by introducing a premixed mixing gas through a rotating valve into the cylinder regardless the rotating direction of the crank shaft, a voltage is supplied until an electrode of the upper surface of the pistons is reached by employing a premixing technic for selectively and directly injecting a file into the cylinder and by performing an electrical at the side of the cylinder where one to three electrodes are embedded or disposed on the upper surface of the piston or in the cylinder liner tub, in case of a direct injection of a diesel engine, a passage of an injected fuel is obtained by differently, similarly, and forming the respective surface aspects of two piston in order to have a larger flow during an ignition is preformed at a position about 2 to 5 mm away from the upper point, or one or two upper portions of the pistons having a center aspects are partially recessed.

* * * * *